US005114594A

United States Patent [19]

Rosebrock et al.

[11] Patent Number: 5,114,594

[45] Date of Patent: May 19, 1992

[54] RAINWATER DIVERTER

[76] Inventors: Linda L. Rosebrock, 770 Pepper Mill Run, Greenwood, Ind. 46143; Ronald L. Rosebrock, deceased, late of Whiteland, Ind., by Linda L. Rosebrock, personal representative

[21] Appl. No.: 661,511

[22] Filed: Feb. 26, 1991

[51] Int. Cl.[5] ..... E04D 13/08; B01D 35/02

[52] U.S. Cl. ..... 210/767; 52/12; 52/16; 137/561 A; 137/357; 137/874; 210/154; 210/433.1; 210/446; 210/459; 210/474; 210/477

[58] Field of Search ..... 210/154, 433.1, 446, 210/459, 474, 477, 767; 137/357, 561 A, 873, 874; 52/12, 16

[56] References Cited

U.S. PATENT DOCUMENTS

| | | | |
|---|---|---|---|
| 971,578 | 10/1910 | Walker | 210/446 |
| 1,213,910 | 1/1917 | Saffian | 210/446 |
| 1,270,274 | 6/1918 | Dunn | 210/446 |
| 1,552,902 | 9/1925 | Werner | 210/446 |
| 3,990,474 | 11/1976 | Harms | 52/16 |
| 4,182,376 | 1/1980 | Nilsson | 52/16 |

*Primary Examiner*—W. Gary Jones
*Assistant Examiner*—Sun Uk Kim
*Attorney, Agent, or Firm*—Woodard, Emhardt, Naughton, Moriarty & McNett

[57] ABSTRACT

Described is a preferred fluid flow diverter, such as a rainwater diverter, having an outer duct, and an inner duct within said outer duct and defining a reservoir to collect fluid. The diverter also includes a drainage duct extending from the reservoir to the exterior of the outer duct. The inner duct has a bypass opening at a height above the drainage duct. In this manner, fluid flowing into the inner duct is diverted through the drainage duct, and excess fluid unable to flow through the drainage duct (e.g. during heavy rains) accumulates in the inner duct to the height of the bypass opening and then excess fluid not retainable by the reservoir flows through the bypass opening and is exhausted through the outer duct. Also described are a rainwater diversion apparatus and method incorporating the preferred fluid flow diverter.

17 Claims, 3 Drawing Sheets

RAINWATER DIVERTER

BACKGROUND OF THE INVENTION

The present invention generally relates to fluid flow diverters, and more particularly to a rainwater diverter for gutter downspouts or the like.

Rainwater has been collected throughout the centuries for consumption, irrigation etc. With the advent of public water and sewage systems, rainwater collection has more recently been primarily for irrigation. This is especially true for home, lawn, and garden care where it is more convenient to provide irrigation using water from the guttering systems of a house rather than using the city water available through the plumbing system of a house. The use of rainwater for irrigation over that of city water also has an inherent cost advantage because many homeowners not only have to pay for the water they use, but also for the sewage associated with that water use.

Also, the collection of rainwater is conservational as it allows for better management and usage of other fresh water supplies. Because changing weather patterns and climatic shifts oftentimes lead to diminished fresh water supplies, especially in arid regions of the country, rainwater collection supplements other water conservation measures such as water rationing, etc.

Various schemes have therefore been created which make use of the water flowing through a gutter downspout. Examples of these schemes include devices which displace a portion of a gutter downspout, thereby providing rainwater diversion to a location other than the bottom of the downspout. One such device is described by Nilsson, U.S. Pat. No. 4,182,376. Another such device is described by Harms, U.S. Pat. No. 3,990,474. The Harms patent device is a diverter insertable in a gutter downspout, which does not alter the downspout water velocity. Rather, it only diverts water through the side of the device. The Nilsson device is a flexible device insertable in a gutter downspout. It can be flexed to one position wherein rainwater flows only down through the gutter downspout. When forced to another position, a collection pocket is formed to divert water from the gutter downspout.

The Harms patent device is limited primarily to water collection, in that the diverted water velocity is relatively uncontrolled. The harder the rainfall, the higher the diverted water velocity and the increased chance erosion rather than irrigation will occur. The Nilsson patent device assumes that rainwater flowing through the gutter downspout will follow the inner contour of the diverter to be collected and exhausted. As can be understood, however, rainwater with a high velocity flowing through the gutter downspout will tend not to follow the inner surface of the diverter when in the collecting position, and will instead be primarily exhausted through the gutter downspout. The Nilsson patent device is therefore relatively highly dependent on the velocity of the rainwater flowing through the gutter downspout. As a result, it is sensitive both to the height at which it is installed in the gutter downspout, and to the manner in which the water flows through the downspout, e.g. effects such as splashing or swirling.

In light of the shortcomings of these and other known devices, there continues to be a need for an improved diverter device to divert water at a desirable rate regardless of whether it is raining hard or rather only sprinkling. Such a desirable device would have the ability to divert all rainfall during a soft rain, yet only partially divert rainfall at a desirable rate during strong downpours. The applicant's invention addresses these needs.

SUMMARY OF THE INVENTION

In brief summary, one preferred embodiment of the present invention provides a fluid flow diverter, such as a rainwater diverter. The preferred diverter has an outer duct, and an inner duct within said outer duct and defining a reservoir to collect fluid. Also included is a drainage duct extending from the reservoir and opening to the exterior of the outer duct. The inner duct has a bypass opening at a height above the drainage duct. As such, fluid flowing into the inner duct is diverted through the drainage duct, and fluid unable to flow through the drainage duct accumulates in the inner duct to the height of the bypass opening, whereupon excess fluid not retainable by the reservoir flows through the bypass opening and is exhausted through the outer duct.

Still other preferred embodiments of this invention include rainwater diversion apparatus and methods incorporating the preferred fluid flow diverter as described in the embodiment above.

A general object of this invention is to provide an improved fluid flow diverter. Another object is to provide an improved rain water diverter that better facilitates the conservation of rainwater. A related object is to provide a rainwater diverter for use in conjunction with gutter downspouts where the velocity of the diverted rainwater is controlled. Another related object of this invention is to provide a rainwater diverter which diverts all the rainwater out the drainage duct for light rain fall and which diverts a constant flow out the drainage duct for heavy rainfall, any excess flow being bypassed into the gutter downspout.

Other objects and advantages of the present invention will be apparent upon reading the following description and appended claims.

DESCRIPTION OF THE PREFERRED EMBODIMENT

Figure 1:
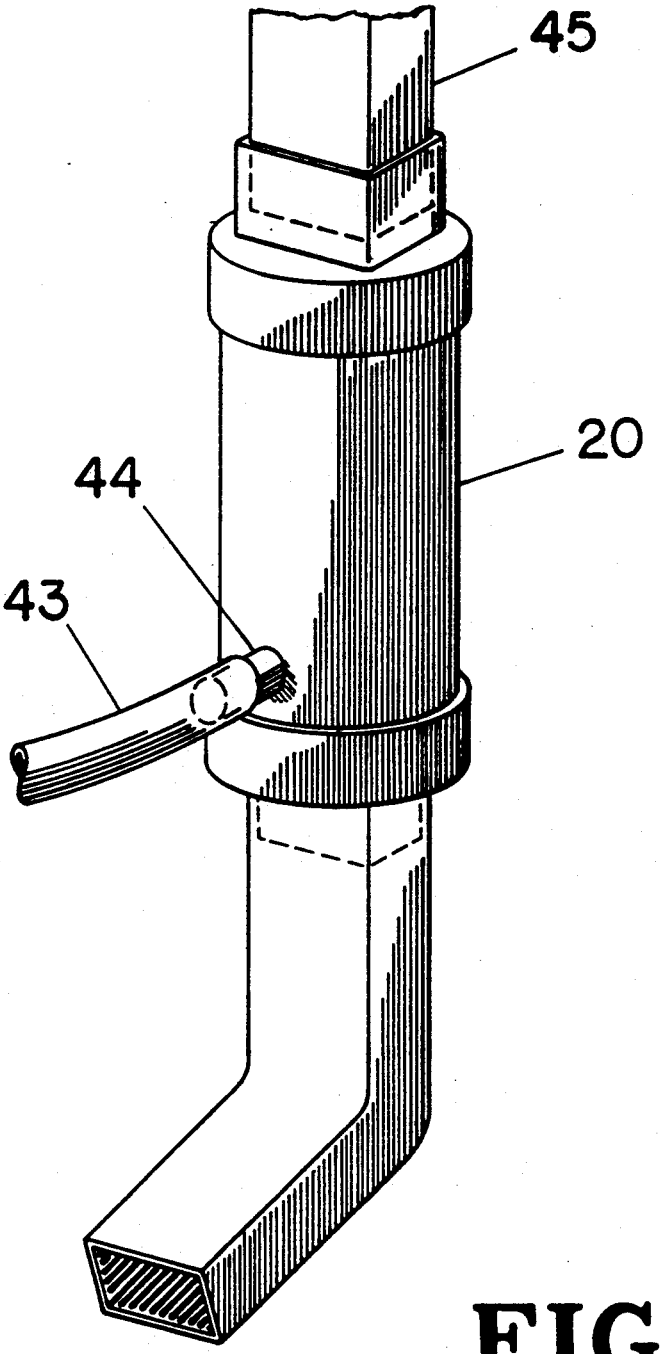
FIG. 1 is a perspective view of a preferred fluid flow diverter according to the present invention, installed in a gutter downspout.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, shown is a perspective view of a preferred rainwater diverter 20 situated in a gutter downspout 45. The rainwater diverter 20 displaces a portion of the gutter downspout and provides a drainage duct 44 for guiding rainwater diverted from flow through the gutter downspout 45. A hose 43 can be connected to drainage duct 44 so that the diverted rainwater can flow to a specific irrigation need. Rainwater diverter 20 in FIG. 1 is shown located near a bottom of the gutter downspout 45. Because the velocity of flow exiting diverter 20 through drainage duct 44 is independent of the velocity of flow through downspout 45, however, the preferred rainwater diverter 20 is equally functional and will provide the controlled diversion of water regardless of its location in gutter downspout 45.

Figure 2:
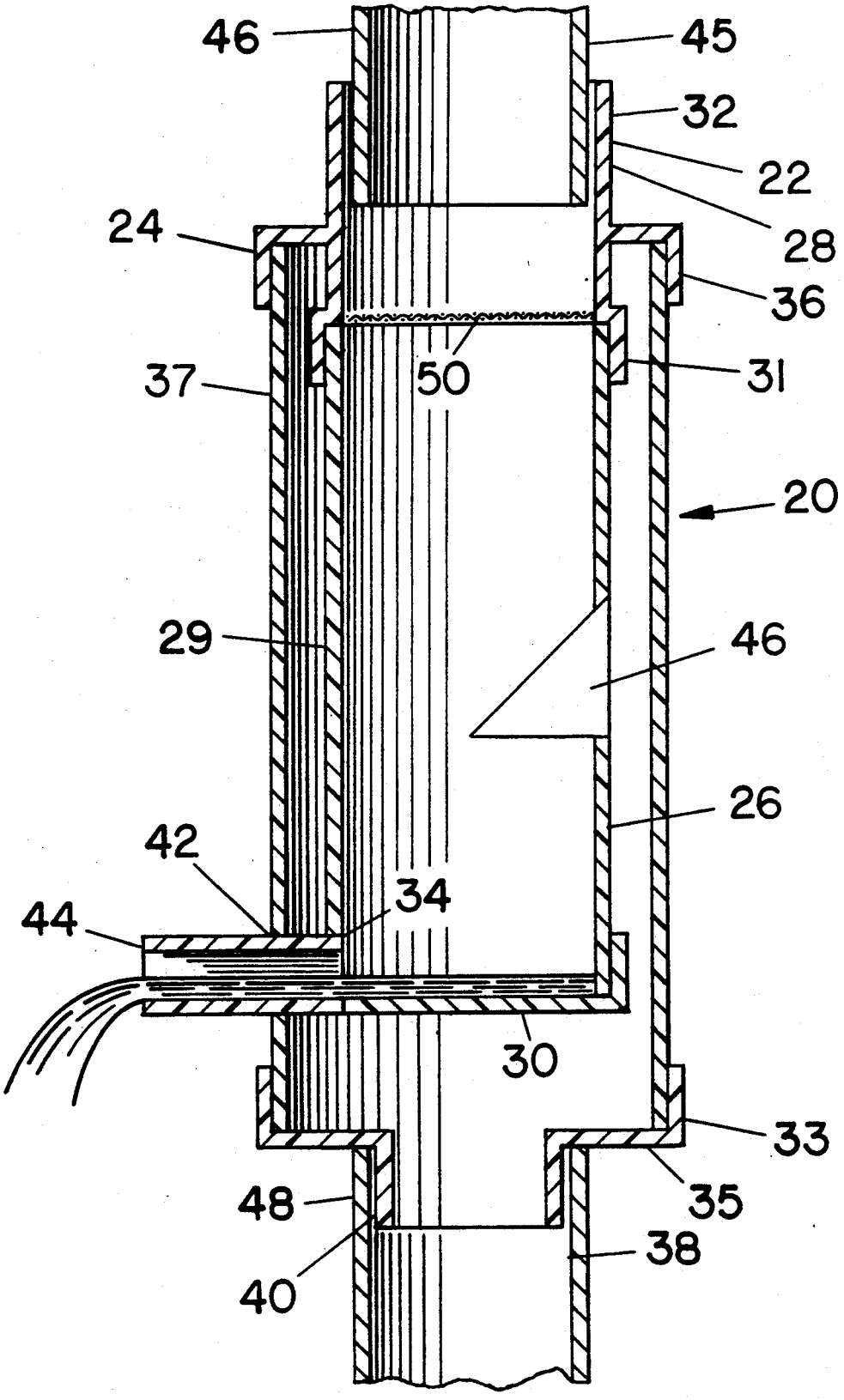
FIG. 2 is an elevational cross-sectional view depicting a preferred fluid flow diverter according to the present invention, with rainwater exiting only through a drainage duct.

Referring now to FIG. 2, shown is a cross-section of preferred rainwater diverter 20. Diverter 20 generally includes an inner duct 22 and an outer duct 24. Inner duct 22 has an open top end 28, a tubular member 29, and a closed bottom end 30, thus defining a reservoir to collect fluid. Open top end 28 incorporates an opening 32 which is adapted to mate with the gutter downspout 45. Top end 28 also incorporates a cylindrically-shaped receiving end 31 and has attached to it outer duct top end 36. A cylindrically-shaped bottom end 30 is preferably employed, whereby tubular member 29 fastens within receiving end 31 and bottom end 30 to form inner duct 22.

A screen 50 is preferably incorporated between tubular member 29 and the receiving end 31 of top end 28. The screen is sized to prevent debris from flowing through and then blocking the diversion of water through drainage duct 44. To clean screen 50, diverter 20 can be removed and the debris emptied from top end 28. In the preferred embodiment, the rainwater diverter 20 is used in a gutter system having other gutter screens, and screen 50 does not provide the primary screening, but instead is a secondary screen requiring infrequent cleaning. In one preferred aspect, a removable screen can be provided which does not require removal of diverter 20 for more frequent cleaning.

Outer duct 24 has top end 36, a bottom end 38 and an outer tube 37. Bottom end 38 is similar to the inner duct top end 28 in that bottom end opening 40 mates with the downspout 45. The bottom end 38 of outer duct 24 also incorporates a cylindrically shaped receiving end 33. Outer tube 37 assembles over tubular member 29 and fastens within top end 36, thereby creating passageway 26. Bottom end 38 then fastens over outer tube 37.

Inner duct 22 and outer duct 24 also incorporate a bottom end opening 34 and a bottom end opening 42 through which drainage duct 44 is inserted and is sealed therein, thereby creating a flow path from the inner duct 22 to the exterior of rainwater diverter 20.

Drainage duct 44, opening 34 and opening 42 are located so that drainage duct 44 is at the bottom of inner duct 22 thereby diverting any rainwater flowing into inner duct 22 and not allowing any rainwater to accumulate unless the flow into inner duct 22 is more than can be diverted through drainage duct 44. Also incorporated within tubular member 29 is a bypass opening 46. Bypass opening 46 can be of wedge or any other suitable shape and size, or can be a number of openings, so long as the total flow area is sufficient to bypass excess flow as desired. As shown in FIG. 2 when rainwater diverter 20 is in place within the gutter downspout 45, drainage duct 44 will divert water flowing through downspout 45.

Figure 3:
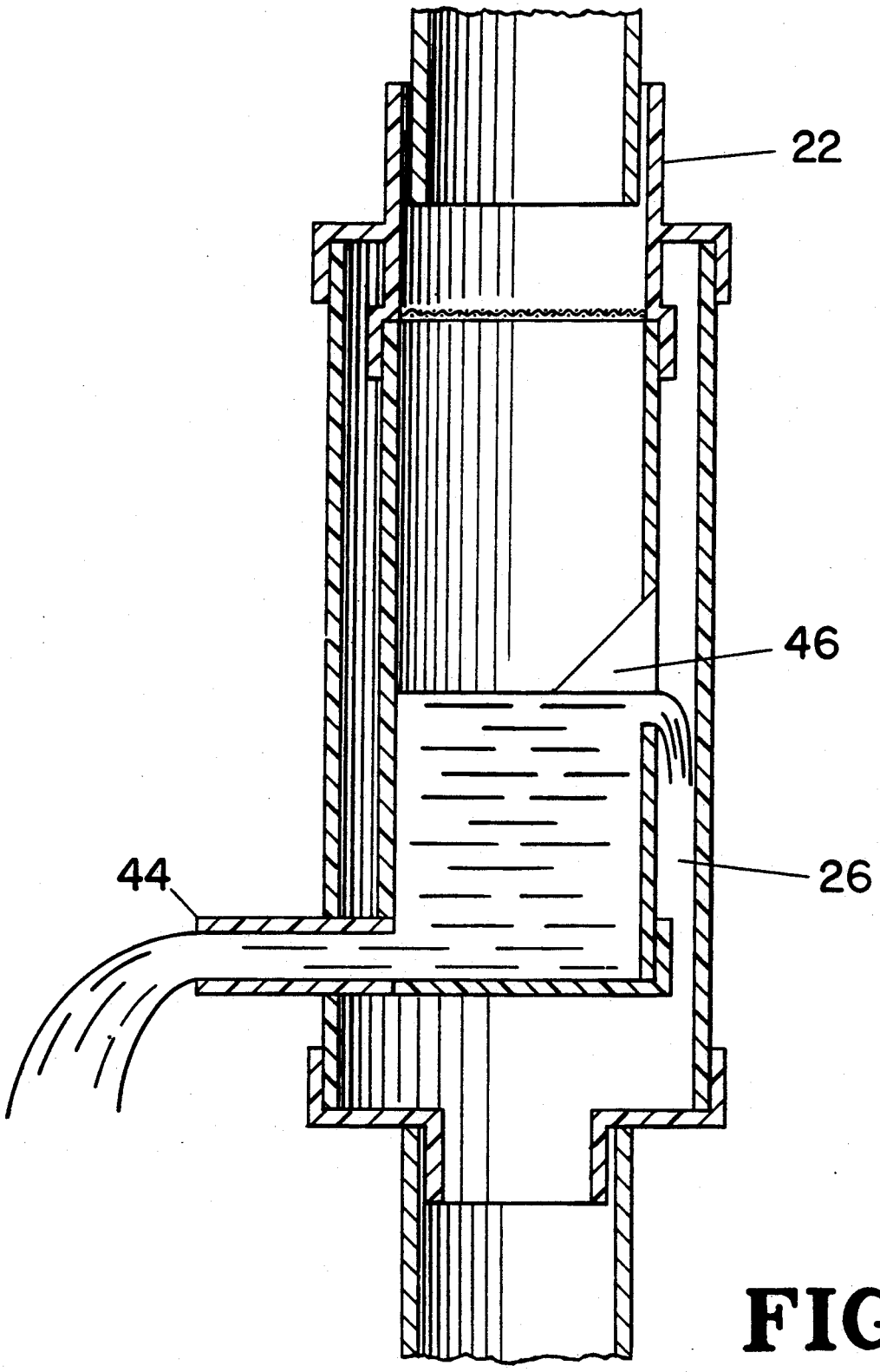
FIG. 3 is an elevational cross-sectional view depicting a preferred rainwater diverter according to the present invention, with rainwater being both diverted through a drainage duct and exhausted via a bypass opening.

Referring now to FIG. 3, if the flow through the downspout is heavy, drainage duct 44 will not be able to divert the total flow through the downspout. In this case, flow will accumulate within inner duct 22 until it reaches the height of bypass opening 46. At this point the flow will spill over and through bypass opening 46 into passageway 26. The excess flow is then exhausted back through the gutter downspout similar to a normal downspout drainage system. As can be seen, once the flow spills over and out through bypass opening 46, a constant flow will exist through drainage duct 44. The velocity of this flow exiting diverter 20 through drainage duct 44 is dependent on the height of bypass opening 46 relative to drainage duct 44. The amount of flow is dependent on the velocity of the flow and the flow area of drainage duct 44. Therefore, the particular design of drainage duct 44 and the location of bypass opening 46 can be controlled and sized to determine the maximum flow and flow velocity through drainage duct 44.

Referring now to FIG. 2, rainwater diverter 20 is installed in gutter downspout 45 whereby a portion of the gutter downspout is cut away, creating an upper downspout 46 and a lower downspout 48. The length of the downspout that is required to be cut away is equal to a distance from the bottom end opening 40 to the screen 50 within receiving end 31. To install rainwater diverter 20, top end 28 slides up over upper downspout 46 until downspout 46 bottoms against screen 50. At this point, the bottom end opening 40 will just clear the lower downspout 48. Once rainwater diverter 20 is in line with downspout 45, diverter 20 is then lowered until the lower downspout 48 contacts shoulder 35 formed by receiving end 33. As can be seen from this assembly technique, top end 28 must be sufficiently deep so that when rainwater diverter 20 is lowered in place with shoulder 33 resting on lower downspout 48, a portion of top end 28 still overlaps upper downspout 46.

Except for screen 50, rainwater diverter 20 is preferably constructed primarily of suitable plastic to resist corrosion and to also provide an inexpensive and easily moldable shape. However, it is envisioned that other materials such as sheet metal similar to that used in gutter downspouts can be employed as well. In one standard size, inner duct top end 28, outer duct top end 36 and receiving end 31 comprise a unitary plastic piece whereby the squarish opening is approximately 5 inches deep with the square being approximately 2 ¾ inches each side The outer duct top end 36 is approximately 1 ¾ inches deep and 4 ½ inches in diameter and is molded to top end 28 2 ¾ inches from opening 32. The cylindrical portion of receiving end 31 is 1 ½ inches deep by approximately 3 ½ inches in diameter. The bottom end 30 of inner duct 22 is approximately 1 ¾ inches deep by 3 ¼ inches in diameter. Top end 28 and bottom end 30 are spaced apart by tubular member 29 which is also composed of plastic and which is 7 inches long by approximately 3 ½ inches in diameter. Upon assembly, tubular member 29 fits snug within bottom end 30 and receiving end 31 thereby providing conforming surfaces so that a standard plastics adhesive may be used to fasten tubular member 29 to bottom end 30 and receiving end 31.

Bottom end opening 34 is about a one inch in diameter hole cut into bottom end 30 and tubular member 29, and tube 29 has also a wedged shaped slot cut into it to create bypass opening 46. The wedge is cut through ½ the diameter of tubular member 29 so that a triangular opening is created 1 ¾ inches deep by 1 ⅜ inches high. Bottom end 38 is constructed similar to top end 28. The cylindrical portion of bottom end 38 is 1 ¾ inches deep by 4 ½ inches in diameter while the squarish portion is 2 ¾ inches high and 2 ¼ inches each side. Outer tube 37 is 1 foot in length by 4 ½ inches in diameter and has a like one inch hole 42 cut into it correlating to the hole 34 cut into bottom end 30 and tubular member 29. Once the outer duct 24 is formed around inner duct 22, drainage duct 44 is inserted through bottom end openings 42 and 34. Drainage duct 44 has about a ¾ inch inner diameter and about a one inch outer diameter so that it conforms to the drainage duct openings thereby providing a close fit for an adhesive seal. Screen 50 is a wire mesh wherein the mesh is sized so that an object larger than 0.25 inches in diameter cannot pass through. Screen 50 is sized so that it is trapped in place between tubular member 29 and receiving end 31. Although the various plastic components are glued together in the illustrated embodiment with an adhesive, it is also envisioned that they may be fastened together for example with sheet metal screws. Also envisioned is a combination of industrial adhesives and fasteners to provide both greater support and sealing. Further, of course, components of the diverter can be unitary rather than assembled and glued as in the illustrated device. This can be accomplished for example by known molding techniques.

While the invention has been illustrated and described in detail in the drawings and foregoing description the same is to be considered as illustrative and not restrictive in character, it being understood that only the preferred embodiment has been shown and described and that all changes and modifications that come within the spirit of the invention are desired to be protected.

What is claimed is:

1. A fluid flow diverter, comprising:

an outer duct;

an inner duct positioned within said outer duct, said inner duct having a closed bottom end and defining a reservoir to collect fluid;

a drainage duct extending into said inner duct and exteriorly of said outer duct;

said inner duct further having a bypass opening to said outer duct at a height above said drainage duct, wherein fluid flowing into the inner duct is diverted through the drainage duct, and fluid unable to flow through the drainage duct accumulates in the inner duct to said height, whereupon excess fluid flows through the bypass opening and exhausts through the outer duct.

2. A fluid flow diverter according to claim 1, and further comprising upper and lower ends matable with a gutter downspout.

3. A fluid flow diverter according to claim 2, wherein said drainage duct is adjacent to said bottom end of said inner duct.

4. A fluid flow diverter according to claim 3, wherein said bypass opening is a wedge-shaped opening.

5. A fluid flow diverter according to claim 3, wherein the upper and lower ends are substantially rectangular in shape.

6. A fluid flow diverter according to claim 3, wherein said lower end is sized to be received in said downspout whereas said upper end is sized to receive said downspout.

7. A fluid flow diverter according to claim 6, wherein said upper and lower ends are substantially rectangular in shape.

8. A fluid flow diverter according to claim 7, and further comprising a screen for filtering fluid entering said inner duct.

9. A fluid flow diverter according to claim 8, wherein said screen is removable.

10. A rainwater diverter apparatus, comprising:

a gutter downspout; and positioned in said downspout, a fluid flow diverter including:

an outer duct;

an inner duct positioned within said outer duct, said inner duct having a closed bottom end and defining a reservoir to collect fluid;

a drainage duct extending into said inner duct and exteriorly of said outer duct;

said inner duct further having a bypass opening to said outer duct at a height above said drainage duct;

wherein fluid flowing down said downspout flows into the inner duct and is diverted through the drainage duct, and fluid unable to flow through the drainage duct accumulates in the inner duct to said height, whereupon excess fluid flows through the bypass opening, through the outer duct and out of the bottom of said downspout.

11. A rainwater diverter apparatus according to claim 10, wherein said drainage duct is adjacent to said bottom end of said inner duct.

12. A rainwater diverter apparatus according to claim 10, wherein said fluid flow diverter is removably mounted in said downspout.

13. A rainwater diverter apparatus according to claim 10, wherein said bypass opening is a wedge-shaped opening.

14. A rainwater diverter apparatus according to claim 10, and further comprising a screen for filtering fluid entering said inner duct.

15. A rainwater diverter apparatus according to claim 14, wherein said screen is removable.

16. A method for diverting rainwater flowing through a gutter downspout, comprising the steps of:

providing a fluid flow diverter including:

an outer duct;

an inner duct positioned within said outer duct, said inner duct having a closed bottom end and defining a reservoir to collect fluid;

a drainage duct extending into said inner duct and exteriorly of said outer duct;

said inner duct further having a bypass opening to said outer duct at a height above said drainage duct; and positioning said fluid flow diverter in said downspout, wherein fluid flowing down said downspout flows into the inner duct and is diverted through the drainage duct, and fluid unable to flow through the drainage duct accumulates in the inner duct to said height, whereupon excess fluid flows through the bypass opening, through the outer duct and out of the bottom of said downspout.

17. A method according to claim 16, wherein said fluid flow diverter is removably mounted in said downspout.

* * * * *